United States Patent [19]

Ito et al.

[11] 4,163,549

[45] Aug. 7, 1979

[54] SEPARATOR DEVICE FOR TRANSFER MEDIUM

[75] Inventors: Yoshio Ito, Yokohama; Yoshikuni Tohyama, Tokyo; Seiji Sagara, Kawasaki, all of Japan

[73] Assignee: Canon Kabushiki Kaisha, Tokyo, Japan

[21] Appl. No.: 777,829

[22] Filed: Mar. 15, 1977

[30] Foreign Application Priority Data

Mar. 23, 1976 [JP] Japan ..... 51-31863

[51] Int. Cl.[2] ..... B65H 29/56

[52] U.S. Cl. ..... 271/174; 271/DIG. 2; 355/3 SH

[58] Field of Search ..... 271/DIG. 2, 174, 80, 271/172; 355/3 R, 3 SH; 118/245; 34/120; 100/174

[56] References Cited

U.S. PATENT DOCUMENTS 3,684,363 8/1972 Ito et al. ..... 271/DIG. 2 X 3,857,560 12/1974 Gundlach ..... 271/DIG. 2 X 3,991,999 11/1976 Brooke ..... 271/DIG. 2 X

*Primary Examiner*—Bruce H. Stoner, Jr.

*Attorney, Agent, or Firm*—Fitzpatrick, Cella, Harper & Scinto

[57] ABSTRACT

This specification discloses improvements in a separating belt disposed between an image-bearing member such as a photosensitive medium or the like and a transfer medium to which the image on the image-bearing member is to be transferred. In the device of the prior art, the separating belt has been fatigued by being subjected to localized friction with respect to the image-bearing member and/or a rotating member for effecting the separation. In the present invention, the separating belt is gradually moved in accordance with the operation of the device incorporating the separating belt therein, whereby the separating belt may be prevented from localized friction and need not be replaced by another belt for a long time.

11 Claims, 12 Drawing Figures

SEPARATOR DEVICE FOR TRANSFER MEDIUM

BACKGROUND OF THE INVENTION a. Field of the Invention

This invention relates to a separator device for separating transfer medium from an image-bearing member. More particularly, it relates to a separator device having a separating belt disposed between an image-bearing member bearing thereon a toner image or an electrostatic latent image, such as a photosensitive medium or insulative medium, and a transfer medium to which the image on the image-bearing member is to be transferred.

b. Description of the Prior Art

A separator device for transfer medium will be described by taking as an example an electrophotographic copying apparatus using a drum-shaped photosensitive medium as an image-bearing member.

An electrophotographic copying apparatus generally comprises a rotatable photosensitive drum and various means disposed about the photosensitive drum successively in the direction of rotation thereof, including means for forming electrostatic latent image on the photosensitive drum, means for developing the electrostatic latent image, means for transferring the developed image to a transfer medium, and means for cleaning the surface of the photosensitive drum. In such an electrophotographic copying apparatus, the transfer medium is urged against the photosensitive drum as by a corona discharger or an image transfer roller during the image transfer, and at that time, the transfer medium becomes electrostatically attracted to the photosensitive drum so intensely that is cannot readily be separated from the latter. It is therefore necessary to provide some separating means and as an example thereof, a method is heretofore known whereby a surface portion of the transfer medium adjacent to the leading edge thereof is guided by a separating belt and separated from the photosensitive drum by a separating roll or the like. This method is highly reliable and preferable. The belt used for such separating means may preferably be formed of a sheet of tough resin material for contact with the photosensitive drum, whereas not only when it is used in its stationary position but also when it is in the form of an endless belt movable round, it is unavoidable for such belt to be in continuous contact with the photosensitive drum or the separating roll.

The separator device in the above-described apparatus of the prior art will now be described by reference to FIGS. 1 and 2. The separator device shown there comprises an endless separating belt stretched between the photosensitive drum and the transfer medium and movable at the same velocity as that of the transfer medium and in the same direction of movement as that of the latter. In FIG. 1 which is a side view of the conventional separator device, reference numeral 1 designates the photosensitive drum having a photosensitive layer 1*a* formed on the peripheral surface thereof and movable in the direction of arrow. In FIG. 1, only the section for the image transfer step and the section for the separating step are shown. There is further seen an image transfer corona discharger 2 and a transfer medium guide 4 for guiding a transfer medium P between the photosensitive drum 1 and the image transfer discharger 2. In the device of FIG. 1, when the toner image on the surface of the photosensitive drum 1 is transferred to the transfer medium P, the transfer medium is electrostatically attracted to the photosensitive drum 1 by the corona discharge and this is the reason why the separator device is required. In the device of FIG. 1, therefore, a separating belt 5 is provided which extends from upstream of the image transfer discharger 2 and passes in front of the discharger 2 toward a rotating separating roller 6 disposed immediately downstream of the image transfer station. The separating belt 5 is in an endless form and is designed to guide a widthwise side edge portion of the transfer medium P without bringing it into contact with the photosensitive drum 1 before image transfer takes place, and to guide the transfer medium away from the photosensitive drum 1 with a predetermined tension after the transfer medium has passed through the position of the image transfer roller, thereby separating the image transfer medium from the photosensitive drum 1. Designated by 7 is a roller disposed at the start end position of the separating belt 5 for imparting follow-up movement to the belt, 8 is a driving roller for imparting frictional rotation to the separating belt 5, and 9 is a guide roller for imparting tension to the separating belt 5, the guide roller 9 being connected to a spring 10 and normally biased thereby to create a tension. The separating belt 5 is moved in the direction of arrows substantially at the same velocity as the transfer medium P as long as the transfer medium P is passing, but one side edge of the separating belt 5 is then in frictional state with respect to the photosensitive drum 1 and therefore, the separating belt 5 should preferably be formed of a material which is low in friction coefficient.

The driving roller 8 should preferably have as large a friction coefficient as possible, like a rubber-coated roll, for example, in order to move around the separating belt 5 without slipping. Designated by 11 is a belt for transporting the transfer medium P to the fixing station, 12 a guide between the separating roller 6 and the belt 11, and 13 a blower which, if required, may be provided for imparting an air flow. When fed through transport rollers 3 and guide 4 and between the photosensitive drum 1 and the image transfer discharger 2, the photosensitive medium P is electrostatically urged against the photosensitive drum 1 by the image transfer discharger 2, whereby transfer of the toner image is effected with the side edge portion of the transfer medium P urged against the photosensitive drum 1 with the separating belt 5 intervening therebetween, namely, with the side edge portion of the transfer medium being forcibly kept off the photosensitive drum while being guided along the lower side of the belt 5 toward the separating roller 6. Then, the transfer medium is guided along the roller 6 and away from the photosensitive drum 1, so that the side edge portion of the transfer medium P is separated from the photosensitive drum 1 as soon as it passes through the position of the image transfer roller, and the side edge portion of the transfer medium becomes greatly separated from the photosensitive drum 1 as the transfer medium is advanced. Thus, the separating action is gradually propagated from the separating belt side toward the widthwisely inner part of the transfer medium, until at least the transfer medium is naturally and reliably separated from the photosensitive drum 1.

Accordingly, as the angle of contact between the separating belt 5 and the separating roller increases, the separating roller 6 should preferably be closer to the transfer discharger 2 as much as possible. Once separated from the photosensitive drum 1, the transfer medium P hangs down onto the separating roller 6 and is guided to the belt 11 through the guide 12 by the friction of the transfer medium with the roller 6. FIG. 2 shows, in perspective view, the separating device of FIG. 1. In the device using the above-described separating belt, the pressure contact of the belt 5 with the photosensitive drum 1 or the separating roller 6 is unavoidable. However, when compared with the case where the separating belt 5 is fixedly stretched, the shown arrangement in which the belt 5 is moved can prevent a specific portion of the belt 5 from being damaged by friction. Nevertheless, even if the belt is of the non-endless type which is moved around, the length of the belt is limited and the durability of the belt is necessarily limited. Of course, if the separating belt is damaged, the separating function of the device will be stopped and the copying operation will be left stopped until the belt is replaced or repaired, and this will economically be very disadvantageous.

In the device of the prior art, as has been noted above, the durability of the separating belt itself is improved by the manner in which the separating belt is stretched, whereby the separating device can be operated for a long time. Nowadays, however, the increased life of the photosensitive drum makes it more and more necessary in the separating device employing the separating belt to prevent the photosensitive drum from being damaged by the separating belt. For this reason, the surface hardness of the photosensitive drum is increased as much as possible and the material for the separating belt which contacts or slidingly contacts such surface of the drum is usually selected on that side of the belt which abrades more easily with respect to the drum surface hardness. In other words, the separating belt may preferably be regarded as an expendable rather than as a permanent article. In this case, however, the life of the separating belt is shorter than the life of the copying apparatus and the separating belt must be periodically replaced, and this entails various problems such as the setting of the belt during the replacement and the procedures involved during the replacement.

Thus, in the separating belt which contacts the photosenstive drum, selection of the material therefore is important and if the separating belt is endowed with durability and wear resistance, the surface portion of the photosensitive drum contacted by the separating belt will undesirably be roughened due to the friction with respect to the belt. If, conversely, a soft material is selected for the belt, the surface and/or end portion of the belt will suffer from deterioration which will lead to the damage as described above. For this reason, the separating belt must be replaced before it is damaged at the end of its life.

SUMMARY OF THE INVENTION

It is a primary object of the present invention to provide a separating device for transfer medium which can perform the separating function for a long time.

It is another object of the present invention to provide a separating device for transfer medium which permits automatic supply of unused or new separating belt and collection of used separating belt.

It is still another object of the present invention to provide a separating device for transfer medium which permits replacement of the separating belt to be automatically effected in relation to the operating time of the image formation apparatus having the separating device.

It is yet still another object of the present invention to provide a separating device for transfer medium which can continue, for a long time, to perform the function of separating transfer mediums electrostatically attracted to the image bearing member.

It is a further object of the present invention to provide a separator device for transfer medium which has a life no less than that of the apparatus body incorporating it and which eliminates the need for maintenance personnel for the separator device.

To achieve the above-noted objects, the present invention gradually moves a separating belt disposed between an image-bearing member such as a photosensitive medium or insulative medium bearing thereon a toner image or an electrostatic image and a transfer medium for receiving the image from the image-bearing member. The transfer medium herein referred to may be sheets of plain paper pre-cut to a predetermined size or a roll of paper. The separating belt of the present invention is neither fixedly located nor moved round in synchronism with the velocity of movement of the image-bearing member or the transfer medium, but is gradually movable. Describing an example of this movement, means for driving the separating belt is provided and this means drives the separating belt in response to the movement of the operating portion within the body of the image formation apparatus, or drives electric motor means in response to an electrical signal to thereby drive said driving means for the separating belt. Effectively, the separating belt is fractionally and intermittently moved by said driving means and such fractional movement permits a long non-endless separating belt to be used to provide a separator device for transfer medium having an extreme durability which could not be attained by the device using the conventional separating belt. Of course, the longer the separating belt, the more effective the separator device, and the separating belt need not always be non-endless but may be a long endless belt. In the case of a non-endless separating belt, when the separating belt has completed one stroke thereof, the movement of the belt is stopped and in such stopped condition, the separating belt becomes similar to the fixed separating belt of the prior art, but if an endless separating belt is used at all, there will be an advantage that the last end of the belt need not always be determined strictly.

The invention will become more fully apparent from the following detailed description thereof taken in conjunction with the accompanying drawings.

DESCRIPTION OF THE PREFERRED EMBODIMENTS

Figure 3:
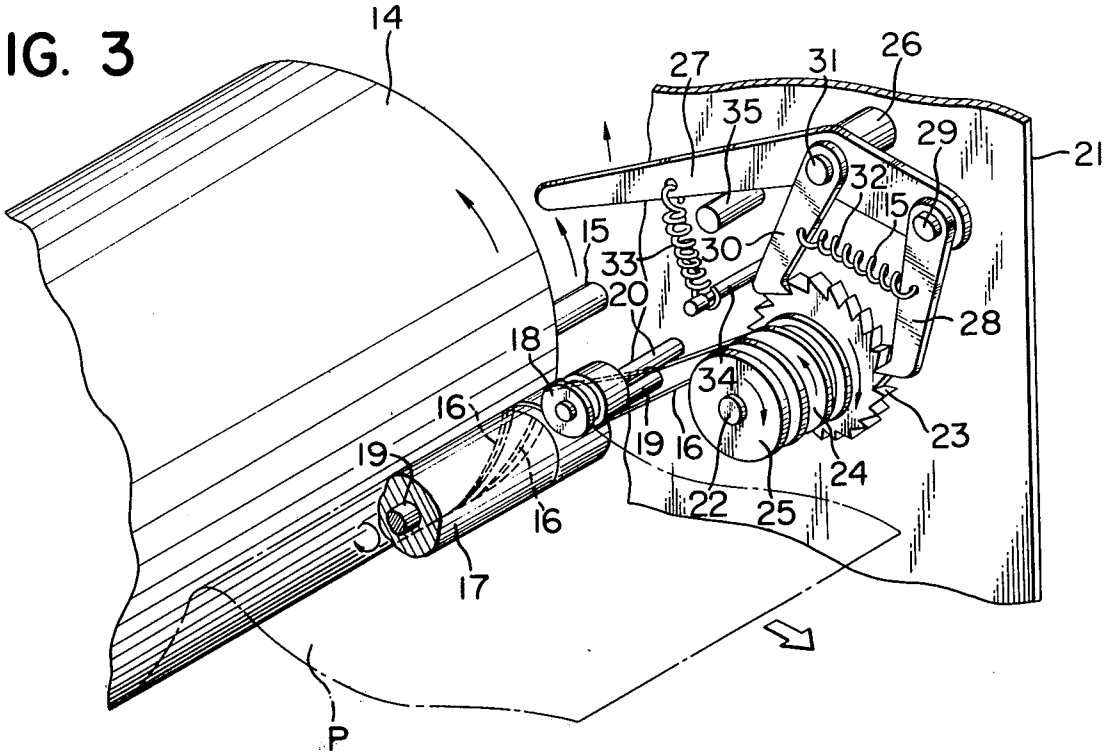
FIG. 3 is a perspective view of the separating device according to the present invention.

The invention will hereinafter be described in detail with respect to some embodiments of the present invention. A first embodiment employs a non-endless separating belt, which may be intermittently moved by utilization of a drum-shaped photosensitive medium. In FIG. 3, a photosensitive drum 14 may be regarded as identical to the photosensitive drum shown in FIG. 1. The photosensitive drum 14 is rotated in the direction of arrow by driving means (not shown), and a projected member 15 acting as a signal pin is secured to one end of the drum 14. Underlying the photosensitive drum 14 is the image transfer station already described in connection with FIG. 1, and transfer medium P having passed through the image transfer station advances in the direction of arrow. When this occurs, the transfer medium P is held between the separating belt 16 and the separating roller 17 with the image-bearing surface thereof facing upwardly, and then the transfer medium is separated from the photosensitive drum 14 and passes below an auxiliary roller 18 toward a fixing station (not shown). The rotatable shafts 19 and 20 of the separating roller 17 and the auxiliary roller 18 are supported by the support wall 21 of the apparatus body. The mechanism for moving the separating belt of the present invention will now be described.

In the present embodiment, the drive source for the separating belt uses a ratchet wheel rotatable by the projected member 15. In FIG. 3, the support wall 21 supports thereon a ratchet wheel 23 to be described and a rotating shaft 22 for supporting reel means on which the separating belt is taken up. The reel means comprises first and second reels 24 and 25, and the unused portion of the separating belt 16 is taken up on the grooved portion of the first reel 24, while the used portion of the separating belt 16 is taken up on the grooved portion of the second reel 25. The separating belt 16 extends from the first reel toward one end of the photosensitive drum 14 and to the forward portion of the image transfer station, from where the separating belt 16 is deflected by a deflecting member such as a roller 7 shown in FIG. 1, and then passes over the end of the transfer medium path zone on the photosensitive drum 14 and further passes over the separating roller 17 and the axuiliary roller 18 to the second reel 25. Incidentally, with respect to the relation between the first and second reels and the ratchet wheel 23, the rotation of the ratchet wheel 23 is directly transmitted to the second reel 25, whereas such rotational force does not act on the first reel 24, which is thus idly rotated. Therefore, the second reel 25 is rotated by an amount of rotation of the ratchet wheel 23, thereby taking up the separating belt 16 by an amount over which it has been used. Also, the separating belt 16 is fed from the first reel 24 by an amount corresponding to the amount of the belt which has been taken up by the second reel 25. Such action becomes possible because the first reel 24 is not directly supported with respect to the rotatable shaft 22. Description will now be made of the mechanism for rotating the ratchet wheel 23 which rotates the second reel 25.

A pivotable arm 27 is pivotally supported on a pivot shaft 26 secured to the support wall 21, and may be rotated in the direction of arrow upon striking of the projected member 15 against the arm 27. On the other end of the arm than that end actuated by the projected member 15, a first pawl 28 for driving the ratchet wheel 23 is pivotally mounted by means of a pin 29. A second pawl 30 for preventing reverse rotation of the ratchet wheel 23 is pivotally mounted coaxially with the pivot shaft 26 of the arm 27. A coil spring 32 has the opposite ends thereof secured to the first pawl 28 and the second pawl 30 to bias them in such directions that the free ends of these pawls normally mesh with the teeth of the ratchet wheel 23. In the above-described construction, when the projected member 15 raises the arm 27, the right-hand end portion of the arm 27 as viewed in FIG. 3 is rotated clockwise to depress the first pawl 28. As the result, the ratchet wheel 23 is rotated in the direction of arrow in proportion to the amount of displacement of the first pawl 28. When the projected member 15 is disengaged from the arm 27 as the result of rotation of the photosensitive drum 14, the arm 27 is returned by a coil spring 33 havng one end secured to a pin 34 secured to the support wall 21, until the arm 27 strikes against a stop 35 secured to the support wall 21. On the other hand, when the first pawl 28 is rotating the ratchet wheel, the second pawl 30 slides on the teeth of the ratchet wheel 23 with rotation of the ratchet wheel 23, in preparation for the next feeding operation, and thus, the second pawl does not interfere with the rotation of the ratchet wheel 23. The spring 32 between the first and the second pawls may only be provided if required, and it may be eliminated by utilizing the gravitational effects on the two pawls.

Figure 4:
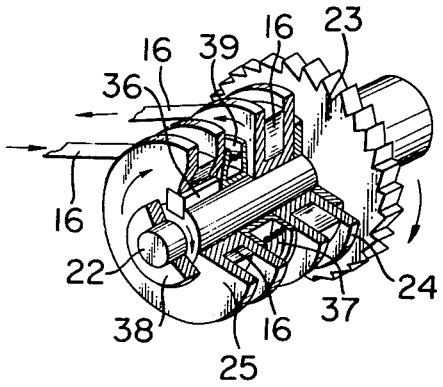
FIG. 4 is an enlarged perspective view, partly in cross-section, of the reel driving section of FIG. 3.

With the above-described construction, the ratchet wheel 23 becomes rotatable in synchronism with the rotation of the photosensitive drum 14. Also, as the second reel 25 is gradually and intermittently rotated with the rotation of the ratchet wheel 23, the separating belt 16 is fractionally taken up on the second reel in accordance with the number of revolutions of the photosensitive drum. The drive for the reels 24 and 25 will hereinafter be described by reference to FIG. 4. FIG. 4 is a perspective view illustrating the relation between the reel members 24, 25 and the ratchet wheel 23 and the rotating shaft 22 supporting them, with the reels shown partly in cross-section. In FIG. 4, the ratchet wheel 23 is secured on the rotating shaft 22, which is rotatable by an amount corresponding to the amount of rotation of the ratchet wheel 23. At one end of the rotating shaft 22, the second take-up reel 25 is secured thereto by means of a key member 36 provided in a recess formed in the shaft 22 and the reel member 25. Thus, the second reel 25 is rotatable by an amount corresponding to the amount of rotation of the shaft 22. Between the ratchet wheel 23 and the second reel member 25, there is the first reel member 24 slidably supported with respect to the rotatable shaft 22, and between the first reel 24 and the second reel 25, there is a compression spring 37 and a friction member 39 provided at the opposite sides of the spring 37. The friction member 39 may be formed of rubber or other material such as a resin of high friction coefficient The friction member 39 is urged against the first reel 24 by the spring 37 to impart a frictional action so that the reel 24 may be rotated in the same direction as the reel member 25. The reel members 24 and 25 tend to repulse each other by the spring 37 and the friction member 39, but since a stationary ring 38 for preventing slip-out of the second reel member 25 is formed on one side of the reel 25, the first reel 24 becomes urged against the ratchet wheel 23. In the separating device now under discussion, the unused portion of the separating belt 16 is taken up on the first reel member 24 at the initial stage of operation, with one end of the belt 16 secured to the second reel 25. The separating belt 16 on the first reel 24 is wound counter-clockwise fashion from the center, as viewed in the shown position. On the other hand, the second reel 25 is rotated with the ratchet wheel 23 by an amount corresponding to the amount of rotation of the latter so that the separating belt is fractionally taken up onto the second reel 25. Also, the first reel 24 tends to rotate with the second reel 25, but the fed portion of the separating belt 16 acts to stop the first reel from rotating, so that the first reel member 24 makes idle rotation on the rotating shaft 22 while imparting a tension to the fed portion of the separating belt 16. With such an arrangement, the tension in the separating belt 16 may automatically be maintained irrespective of the variations in outside diameter of the portions of the separating belt 16 taken up on the two reels 24 and 25. Thus, the separating belt is always tensioned independently of the amount of the separating belt taken up by the second reel 25, so that the separating function of the separating belt is never decreased.

Figure 8:
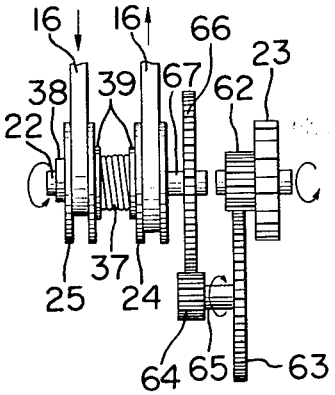
FIG. 8 is a top plan view showing the speed reduction mechanism for the reel driving section.

With the above-described arrangement, the separating station may be supplied with a new portion of the separating belt when the used portion of the belt becomes fatigued, and such fatigued belt portion will no longer be subjected to the friction for the separation. As the result, there is no fear that the separating belt should be fatigued and damaged. In addition, the separating belt comes off the frictional position in a predetermined time, and this permits the separating belt to be formed of relatively soft material, which may in turn lead to minimization of the damage imparted to the photosensitive drum surface by the belt. In the separating device now under discussion, if the outside diameter of each reel member is set to about 3 cm, and if use is made of a belt of polyethylene terephthalate having a thickness of several tens of microns, the reel member can take up the separating belt for a length of about 5 to about 6 meters. Also, by suitably setting the amount of rotation of the ratchet wheel 23, the separating belt in the separating device of the prior art had to be replaced after the completion of copies of the order of 20,000 sheets, whereas in the device of the present invention, the separating belt can continue to perform its function for the production of about 1,000,000 copies. In the above-described embodiments, rotation of the ratchet wheel 23 is directly utilized to drive the take-up reel 25 for the separating belt 16, but it is possible to use a reduction gearing mechanism as shown in FIG. 8. If such mechanism is used, the supply of unused portion of the separating belt 16 may be made more fractional. The prevention of rotation of the first reel 24 in the slackening direction may be achieved not only by the above-described combination of the spring and friction member, but also by the spring 39 alone or by a mechanism having a fixed end at a location independent of the reel mechanism section. Replacement of the belt may be easily effected by removing the fixing ring 38 and replacing the reel by a new one.

Figure 5:
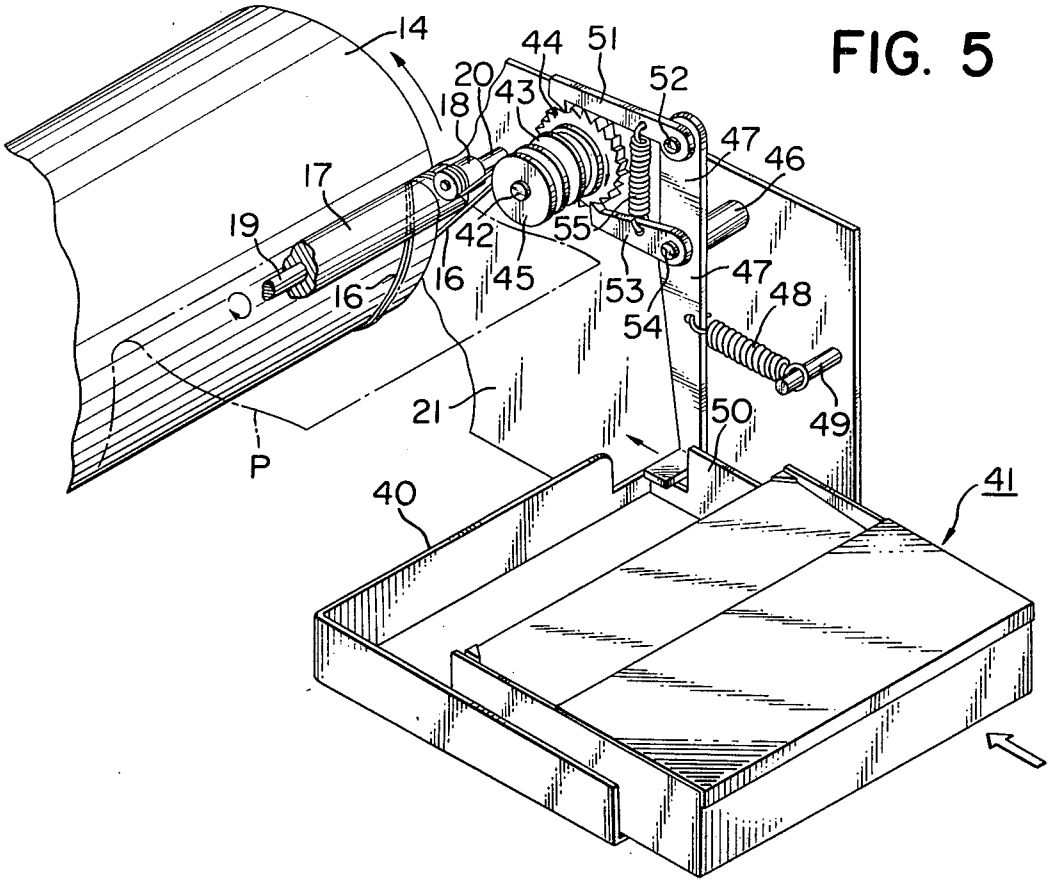
FIG. 5 is a perspective view of the separating device according to another embodiment of the present invention.
Figure 6:
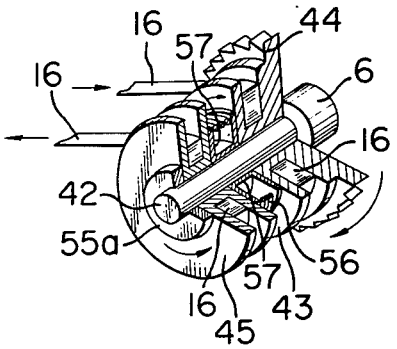
FIG. 6 is an enlarged perspective view, partly in cross-section, of the reel driving section of FIG. 5.

In the embodiment described above in connection with FIG. 3, a part of the operating portion of the image formation apparatus is used as a driving signal source. In another embodiment shown in FIG. 5 and hereinafter described, a part of a member mounted and dismounted with respect to the image formation apparatus is used as a driving signal. In FIG. 5, there is seen a photosensitive drum 15, a separating belt 16, a separating roller 17 mounted on a rotating shaft 19, an auxiliary roller 18 mounted on a rotating shaft 20, and a support wall 21 which is identical to that described in connection with FIG. 3 and need not be described further. Again in the embodiment of FIG. 5, a ratchet wheel is employed as the direct drive source for driving the reel, but is somewhat differs in construction and operation from the ratchet wheel of FIG. 3. In FIG. 5, a cassette positioning member 40 is provided along which a cassette 41 containing therein cut sheets is inserted and mounted in place within the image formation apparatus. Such a cassette is disclosed in U.S. Pat. No. 3,919,972. The support wall 21 supports thereon a rotating shaft 42 for supporting thereon the reel for taking up the separating belt and the ratchet which provides the drive source for the reel. In the present embodiment, a second reel 43 for taking up the used portion of the separating belt is integrally formed with the ratchet wheel 44. A first reel 45 on which the unused portion of the separating belt is mounted on the rotatable shaft 42 at one end thereof for sliding movement with respect to the shaft 42, as is the first reel member 24 of FIG. 4. Describing the driving mechanism for the ratchet wheel 44, a pivotable arm 47 is pivotally supported on a pivot shaft 46 secured to the support wall 21, and one end of this arm 47 acts to detect the presence of the cassette 41. A coil spring 48 has one end thereof secured to the arm 47 and the other end thereof secured to a pin 49 on the support wall 21. Thus, the arm 47 is acted on by a force which rotates the arm counter-clockwise about the shaft 46, as viewed in FIG. 5. However, one end of the arm 47 strikes against the cut-away portion 50 of the cassette positioning member 40, and is stopped in the position shown. On that end of the arm 47 which is adjacent to the ratchet wheel 44, a first pawl 51 for driving the ratchet wheel 44 is pivotally mounted by means of a pin 52. A second pawl 53 for preventing reverse rotation of the ratchet wheel 44 is pivotally mounted on the arm 47 by means of a pin 54 coaxially with the rotatable shaft 46. A coil spring 55 is provided between and secured to the two pawls to bias them so that the pawled ends of these pawls may act on the teeth of the ratchet wheel. Operation of the separating device of the above-described construction will now be described. For example, assume that the cut sheets in the cassette 41 have been used up and the cassette 41 is to be replaced by a new one. When the empty cassette 41 is removed, the arm 47 is pulled on by the spring 48 and rotated about the pivot shaft 46 until one end of the arm strikes against the cut-away portion 50. At that time, the first pawl 51 slides on the teeth of the ratchet wheel 44 while the second pawl 53 remains immovable to fix the ratchet wheel 44. With such pivotal movement of the arm 47, the first pawl 51 becomes ready to effect the next rotation of the ratchet wheel 44. When a new cassette 41 is properly inserted with the aid of the positioning member 40, the cassette 41 causes the arm 47 to be rotated by a predetermined amount of displacement against the resilient force of the spring 48. At that time, the first pawl 51 meshes with the ratchet wheel 44 to rotate the wheel 44. At the same time, the second pawl 53 slides on the teeth of the ratchet wheel. Since the second reel member 43 is integrally formed with the ratchet wheel 44, this second reel takes up the separating belt 16 by an amount corresponding to the amount of rotation of the ratchet wheel 44. Details of the reel means in the present embodiment will now be described by reference to FIG. 6.

Since the second reel 43 for taking up used portion of the separating belt 16 is integrally formed with the ratchet wheel 44, as shown, the reel reliably takes up the separating belt 16 with the rotation of the wheel 44. On the other hand, the first reel member 45 on which unused portion of the separating belt 16 is wound is mounted loosely with respect to the shaft 42, and a fixing ring 55*a* is provided on the end of the shaft 42 to prevent the first reel 45 from slipping off the shaft. Disposed between the first and second reels 45 and 43 is a member for holding the first reel 45 against the fixing ring 55. This member comprises a compression coil spring 56 and a friction member 57 as described in connection with FIG. 4. By the friction member 57, the first reel 45 tries to rotate in the same direction as the ratchet wheel 44, but since the separating belt on the first reel is taken up counter-clockwisely from the center as viewed in FIG. 6, the first reel does not rotate in the same direction as the second reel and instead, rotates in the reverse direction. Thus, the separating belt 16, as in the embodiment of FIG. 3, becomes movable while being under tension by the first reel reversely rotating with respect to the second reel. Thus, whenever all the transfer mediums P contained in the cassette have been used up for copying, the operator of the apparatus may remove the cassette 41 from the main body of the apparatus and place new transfer mediums in the cassette 41 and thereafter, may restart the copying work. Therefore, feeding of the separating belt becomes possible whenever several sheets of copies have been completed. In this instance, the feeding of the separating belt does not take place for each complete rotation of the photosensitive drum as in the previous embodiment, it becomes unnecessary to provide the means for reducing the number of revolutions which may be provided between the ratchet wheel and the second pulley.

In the first embodiment of FIG. 3 and the second embodiment of FIG. 5, the time during which the separation belt for contact with the photosensitive drum makes contact with such drum or the separating roller can be freely determined by the number of teeth of the ratchet wheel, the diameter of the reel, the amount of rotation of the ratchet wheel, and may be set to an appropriate value by taking into account the materials of the separating belt and the surface of the image-bearing member. In case of a copying apparatus, the drive source for the arm for driving the ratchet wheel is not limited to the photosensitive drum within the apparatus, but may be the drive shaft of the developing device or of the feed roller for feeding transfer medium, the shaft portion of the rolled transfer medium, or the optical member such as a mirror or original carriage moving when no exposure is taking place. Further, in the case as shown in FIG. 3 wherein the arm is actuated by the pin provided on the photosensitive drum, it is preferable to prevent the pin from striking the arm during exposure, thereby avoiding occurrence of blur or the like. On the other hand, in the case as shown in FIG. 5 wherein a member removably mounted with respect to the copying apparatus is used as the signal source, the drive source may be not only the cassette but also the container for containing a supply of developer.

Alternatively, the intermittent feeding mechanism for the separating belt may be provided by combining a plunger with the drive for the ratchet wheel and operating the plunger with the aid of detection signal resulting from the detection of the drive of the driving portion within the apparatus. As a further form of the driving mechanism for the separating belt, a one-way clutch and a micromotor or the like may be combined together to rotate the pulley on which the separating belt is wound. Where the plunger or the micromotor is used for the drive source, an electrical signal may be taken out of the operation control section of the copying apparatus to operate the plunger or the like. The separating belt driven from such drive means is frictionally moved while keeping contact with the surface of the image-bearing member, and the direction of such movement may be the same as or opposite to the direction of movement of the image-bearing member. For example, if the separating belt is moved in the same direction as the direction of rotation of the image-bearing member, it will be possible to decrease the drive force for the movement and if the separating belt is moved in the opposite direction, it will be possible to increase the tension of the belt.

Figure 7:
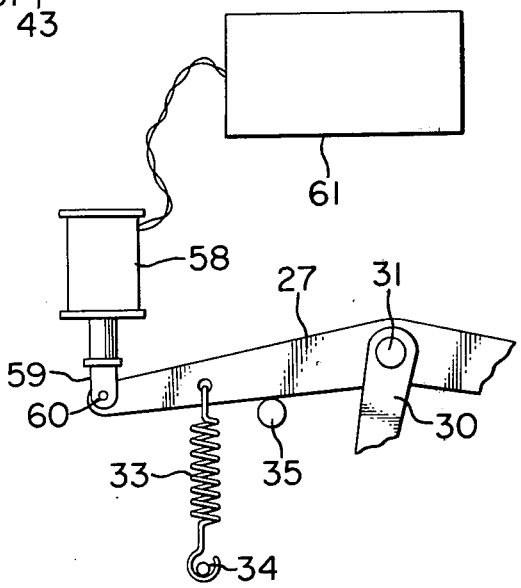
FIG. 7 is a fragmentary side view showing a form of the drive for ratchet wheel.

Some important modifications of the above-described embodiments will hereinafter be described by reference to FIG. 7 and so on. FIG. 7 shows a modification in which the pivotable arm of the FIG. 3 embodiment is operated by an electromagnetic plunger. In FIG. 7, there is seen an electromagnetic plunger 58 having an actuator 59, and a pin 60 for pivotably rotating the end of the actuator 59 and the end of the arm 27. The plunger 58 is operated by an electrical signal from a control unit 61 and, when a current flows to the plunger 58, the actuator 59 is attracted in the direction of arrow, thereby rotating the arm 27 clockwisely about the pin 31. By this, the ratchet wheel 23 is rotated to effect intermittent feeding of the separating belt. When the current supply to the plunger 58 is discontinued, the arm 27 is returned to its start position by the spring 33.

FIG. 8 shows a modificaton in which the amount of rotation of the FIG. 3 ratchet wheel is decreased to reduce the take-up amount of the separating belt. In FIG. 8, there is seen a first spur gear 62 integrally formed with the ratchet wheel 23, a second spur gear 63 meshing with the gear 62, a third spur gear 64 secured to the rotating shaft 65 of the second spur gear, and a fourth spur gear 66 meshing with the gear 64, the rotating shaft 67 of the spur gear 66 supporting thereon the first 24 and the second reel 25. With such a mechanism, it is possible to fractionize the amount of feed of the separating belt even if the ratchet wheel 23 is rotated for each complete rotation of the photosensitive drum 14.

Figure 9:
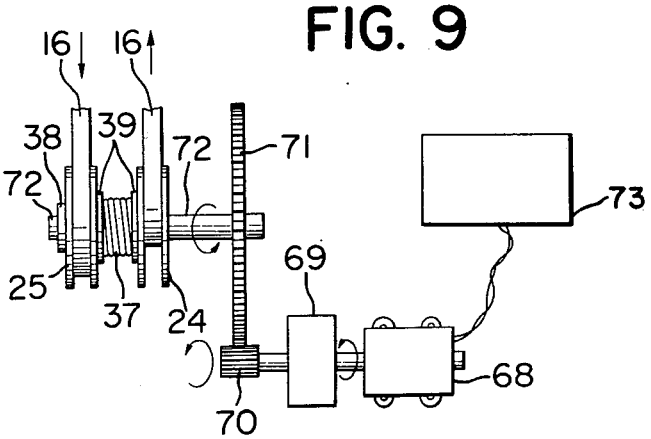
FIG. 9 is a top plan view showing another form of the reel driving section.

FIG. 9 shows an embodiment in which a micromotor and a one-way clutch are combined together to intermittently move the separating belt. The reel means has the same mechanism as that shown in the embodiment of FIG. 3. In FIG. 9, a micromotor 68 is intermittently rotated by the current from a control unit 73. The rotation of the motor 68 is transmitted through a one-way clutch 69 to a driving gear 70. The rotation of the first gear 70 is transmitted to a first spur gear 71 meshing with the gear 70, to rotate the rotatable shaft of the spur gear, namely, the rotatable shaft 72 supporting the reels 24 and 25, thus intermittently feed the separating belt 16. In this embodiment, the gears may be provided as required, and the rotatable shaft 72 may alternatively be rotated by a rotational force directly transmitted through a clutch 69. The clutch 69 in this embodiment prevents deenergization of the motor 68 from causing the belt 16 to be slackened.

Figure 10:
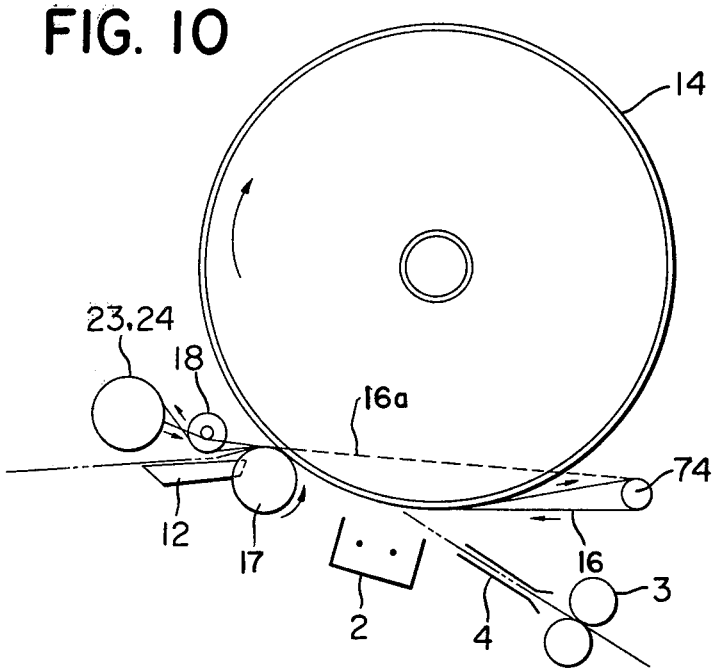
FIG. 10 is a side view of the separating device and showing an arrangement of the separating belt.

FIG. 10 is a side view of the separator device section showing an example of the separating belt arrangement. The arrangement shown there corresponds to that of FIG. 3. Designated by 74 is deflecting roller means which may comprise one or more rollers. In such embodiment, the separating belt 16 during its reciprocal movement is subjected to friction with respect to the surface of the photosensitive drum 14, but no problem occurs because the belt surface subjected to the friction is reversed between the forward and the backward stroke of the belt. Alternatively, as in the embodiment of FIG. 5, arrangement may be made such that the portion of the separating belt which is not used for the separation is kept off the surface of the photosensitive drum 14. Indicated by a dotted line 16*a* is such portion of the separating belt which is kept off the surface of the photosensitive drum 14.

Figure 11:
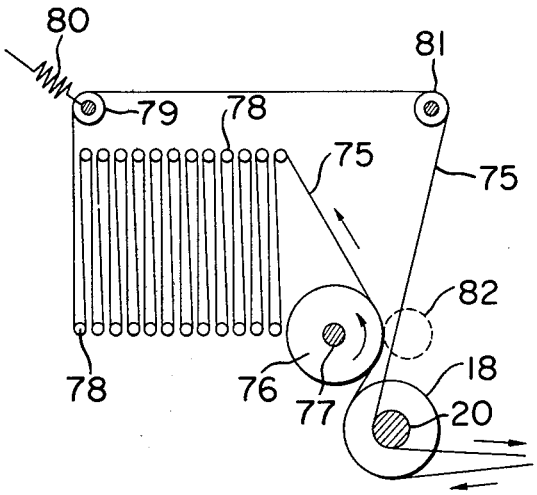
FIG. 11 is a side view of the belt driving section of the present invention using an endless separating belt.
Figure 12:
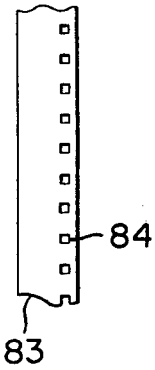
FIG. 12 is a plan view of another form of the separating belt suitable for use in the embodiment of FIG. 11.

FIG. 11 shows an embodiment in which the separating belt is shaped in an endless form. Designated by 75 is the endless separating belt. The separating belt 75 is extended over a driving roller 76 so that it is gradually moved in the direction of arrow by the driving roller 76 which is rotating in the direction of arrow. The driving roller 76 is in turn driven by the mechanism described in connection with the embodiment of FIG. 8. The rotatable shaft 77 of the roller 76 corresponds to the rotatable shaft 67 in the embodiment of FIG. 8. With such arrangement, each intermittent rotation of the intermittently rotated driving roller 76 feeds the belt 75 in frictional contact therewith in the direction of arrow. Designated by 18 and 20 are the auxiliary roller and its rotatable shaft which have already been described in connection with the embodiment of FIG. 3. The separating belt is extended over a number of rotatable shafts 78 which serve to store the unused portion of the separating belt. Such unused portion of the separating belt 75 is supplied by an amount corresponding to the amount of the belt taken up by the take-up driving roller 76. Designated by 79 and 81 are rollers for deflecting the belt, and denoted by 80 is a coil spring for imparting a suitable tension to the belt. Means for reliably transporting the separating belt may be provided by urging an auxiliary roller 82 against the driving roller and maintaining good contact between the driving roller 76 and the separating belt 75, thereby enabling the separating belt to be reliably taken up. Now, the contact between the separating belt and the image-bearing member will be considered. Sufficiently tensioned state of the belt 75 may be brought about by urging the forward stroke portion of the belt into contact with the separating roller and/or the image-bearing member to thereby endow the belt with the separating function while keeping the backward stroke portion of the belt off these frictional members, in the manner as indicated by the dotted line 16*a* in FIG. 10. The effect resulting from such use of the endless separating belt lies in that after all the unused portion of the separating belt has been fed, the already used portion of the separating belt is now fed and the belt is never stopped. This means that the time between belt replacements can be varied. In the case of a non-endless separating belt, the belt is all taken up when several millions of copies have been produced and the result is that the belt arrangement becomes identical to the conventional fixed belt arrangement. In the present embodiment, however, the belt is endless and continues to move round for more or less time even if the belt is not replaced, and there is no fear that the belt should become ready to be damaged. FIG. 12 shows another form of the separating belt 75 shown in FIG. 11. In FIG. 11, transport of the separating belt 75 is effected by the friction force of the driving roller 76, whereas a good result may be obtained by the form as shown in FIG. 12 wherein the belt 83 is formed with perforations so that such perforations may cooperate with a sprocket to transport the belt.

According to the present invention, as has been described above, the separating belt is gradually driven without friction being localized to specific portions of the belt and accordingly without damage being imparted to such specific portions. Also, according to the separating mechanism of the present invention, the separating belt is automatically transported and this eliminates the necessity of maintenance and/or replacement of the separating belt until several millions of copies are completed. In the conventional arrangement wherein the separating belt is moved with the rotation of the image-bearing member or the separating roller, the belt is frequently stretched or deflected in a short time and this has rather accelerated the fatigue of the belt. In addition, the conventional arrangement has required the provision of a mechanism for constantly driving the separating belt and such mechanism has more operating portions than the mechanism of the present invention effecting gradual drive, and accordingly is more liable to suffer from failures or other troubles in these operating portions.

Figure 1:
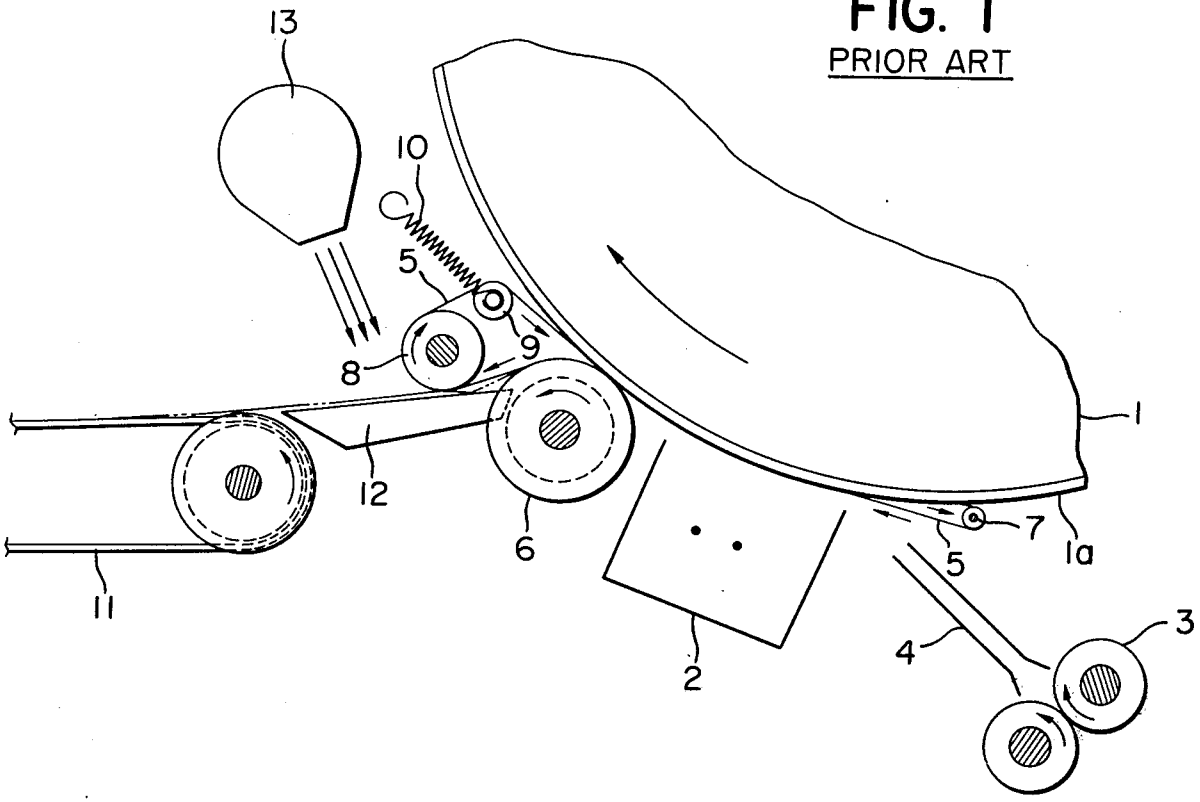
FIG. 1 PRIOR ART
FIG. 1 is a side view of the separating device in the copying apparatus according to the prior art.
Figure 2:
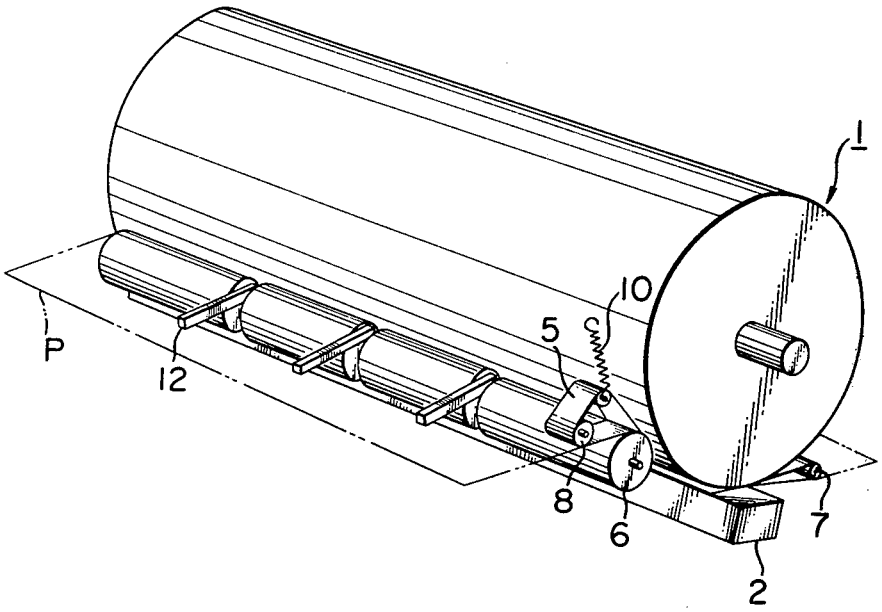
FIG. 2 PRIOR ART
FIG. 2 is a perspective view of the separating device of FIG. 1.

The separating belt in the separator device of the present invention, as described more or less with respect to the various embodiments, may be formed of polyethylene terephthalate film, or such film consolidated by glass fiber, or synthetic resin film. The thickness of the separating belt may range from about 50 to about 150 microns with its wear resistance taken into account, and the width of the belt may be 10 to 20 mm. The width of the belt is correlated with the strength of the belt itself, and may also be selected to the order of 2 to 5 mm if the belt is strong. In the separaor device of the present invention, the belt take-up reel which provides the storage means for the separating belt can be easily constructed to a diameter of 30 to 40 mm and the reel of such diameter can take up a separating belt having a length of 6 to 7 meters. By designing the device such that take-up of such belt is completed when several millions of separations have been terminated, the separator device of the present invention can perform the separaton several million times. As compared with the conventional fixed belt system which can perform the operation about twenty thousand times at best, the separator device of the present invention can perform its separating operation for an extremely long-time without maintenance involved. Also, even in the case where the separating belt is gradually moved as an endless belt instead of a non-endless belt, there is not only the merit of the long-time continued separating operation but also a merit that the endless construction of the belt is useful to prevent the belt from being fixed even if it is left unreplaced. Further, as compared with the conventional separator device as shown in FIG. 1 wherein the reciprocable belt is guided to between the image-bearing member and the transfer medium and the backward stroke portion of the belt is moved in the same direction and at the same velocity as the transfer medium, the separator device of the present invention enables the amount of friction at a specific portion of the separating belt to be reduced and this leads to a longer life of the belt.

The separating belt has been shown only as taking a belt-like form, whereas a linear form is also conceivable for the separating belt. However, if separation is forcibly effected by the linear belt when the mutual attraction between the transfer medium and the image-bearing member is strong, the transfer medium contacting the belt might be damaged and attention must be paid to this.

The separator device of the present invention is applicable not only to the copying apparatus as shown herein, but also to a recording apparatus or an image formation apparatus in which transfer medium is rapidly separated from the image-bearing member.

What we claim is:

1. A separator device for use in an image formation apparatus wherein an image is transferred from a movable image bearing member to a transfer material, comprising:

a separation roller disposed downstream of a position where an image on the image bearing member is transferred onto the transfer material;

a separation belt disposed to contact the image bearing member at said transfer positon and to keep a lateral end portion of the transfer material out of contact with the image bearing member, wherein said separation belt also contacts said separation roller to guide the transfer material in a direction away from the image bearing member;

rotatable means for storing an unused portion of said separation belt wound therearound;

means for restraining the rotation of said storing means in a direction to feed out the unused portion of said belt;

means for taking up thereon the used portion of said belt;

means for feeding the belt from said belt storing means to said belt take-up means against the restraining action of said restraining means; and means for actuating said feeding means in response to the movement of an element which moves during an image formation process of said image formation apparatus.

2. A device according to claim 1, wherein said element is the image bearing member which moves during the image formation process.

3. A device according to claim 1, wherein said actuating means includes a ratchet mechanism.

4. A device according to claim 1, wherein said storing means and take-up means are mounted on a common shaft.

5. A device according to claim 1, wherein said take-up means also functions as said belt feeding means.

6. A device according to claim 1, wherein said actuating means is operated in response to a signal indicative of the operation of means for driving said image formation apparatus.

7. A separator device for use in an image formation apparatus wherein a toner image is transferred from a movable image bearing member to a transfer material, comprising:

a separation roller disposed downstream of a position where a toner image on the image bearing member is transferred onto the transfer material;

a separation belt disposed to contact the image bearing member at said position and to keep a lateral end portion of the transfer material out of contact with the image bearing member, wherein said separation belt also contacts said separation roller to guide the transfer material in a direction away from the image bearing member;

rotatable means for storing an unused portion of said separation belt wound therearound;

means for restraining the rotation of said storing means in a direction to feed out the unused portion of said belt;

means for taking up thereon the used portion of said belt;

means for feeding the belt from said belt storing means to said belt take-up means against the restrained action of said restraining means; and means for actuating said feeding means in response to movement of an element which moves when an image formation process of said image formation apparatus is not being carried out.

8. A device according to claim 7, wherein said element comprises a cassette for storing the transfer material.

9. A device according to claim 7, wherein said actuating means includes a ratchet mechanism.

10. A device according to claim 7, wherein said storing means and take-up means are mounted on a common shaft.

11. A device according to claim 7, wherein said take-up also functions as said belt feeding means.

* * * * *

UNITED STATES PATENT OFFICE

CERTIFICATE OF CORRECTION

Patent No. 4,163,549 Dated August 7, 1979

Inventor(s) YOSHIO ITO, ET AL.

It is certified that error appears in the above-identified patent and that said Letters Patent are hereby corrected as shown below:

Column 1, line 33, "is" should read --it--;

Column 2, line 64, "roller" should read --roller 6--;

Column 10, line 6, "detection" should read --a detection--;

Column 12, line 44, "separaor" should read --separator--;

Column 12, line 53, change "separaton" to --separation--.

Signed and Sealed this

*Fifth* Day of *February 1980*

[SEAL]

*Attest:*

SIDNEY A. DIAMOND

*Attesting Officer*

*Commissioner of Patents and Trademarks*